United States Patent [19]

Bar

[11] 4,410,303

[45] Oct. 18, 1983

[54] MOTOR-COMPRESSOR UNIT FOR REFRIGERATORS

[75] Inventor: Alfredo Bar, Pavia, Italy

[73] Assignee: NECCHI Societa per Azioni, Pavia, Italy

[21] Appl. No.: 267,918

[22] Filed: May 28, 1981

[30] Foreign Application Priority Data

Jun. 9, 1980 [IT] Italy ..... 42916 A/80

[51] Int. Cl.[3] ..... F04B 39/00

[52] U.S. Cl. ..... 417/312; 417/424; 417/902

[58] Field of Search ..... 417/313, 312, 902, 363, 417/424; 181/403; 62/296

[56] References Cited

U.S. PATENT DOCUMENTS

| | | | |
|---|---|---|---|
| 2,243,466 | 5/1941 | Kucher | 417/902 X |
| 3,049,285 | 8/1962 | Doeg | 417/902 X |
| 3,498,530 | 3/1970 | Hover | 417/902 X |
| 3,817,661 | 6/1974 | Ingalls et al. | 417/902 X |

*Primary Examiner*—Edward K. Look

*Attorney, Agent, or Firm*—Stevens, Davis, Miller & Mosher

[57] ABSTRACT

A motor-compressor unit for refrigerators provided with tubes for feeding the gas from the hermetic container to the cylinder suction chamber. A main tube communicates with the suction chamber by way of the relative silencer, while two supplementary tubes communicate directly with the suction chamber. The configuration and dimensions of the main tube and supplementary tubes have been chosen to obtain a noise reduction without reducing the throughput of the induced gas.

2 Claims, 1 Drawing Figure

MOTOR-COMPRESSOR UNIT FOR REFRIGERATORS

BACKGROUND OF THE INVENTION

This invention relates to a motor-compressor unit for refrigerators, and more particularly to the means for feeding the refrigerant gas contained in the hermetically sealed container to the suction chamber provided in the motor-compressor cylinder head.

The object of the invention is to find an optimum design which ensures that a sufficient throughput of refrigerant gas is drawn in while at the same time giving rise to minimum noise caused by the intermittent movement of the gas in the suction conduits.

The technical problem to be solved in order to attain the object was to create a new configuration and arrangement of the suction conduits which would ensure that the refrigerant gas throughput and the pressure drops in the gas stream, which are created in order to reduce the noise generated by this stream, and rationally distributed between a main suction tube and supplementary suction tubes.

SUMMARY OF THE INVENTION

The solution to the technical problem is characterized in that the feed means are constituted by a main tube in communication at one end with the interior of the container and at the other end with a silencer which is itself connected to the suction chamber, and by supplementary tubes which directly connect the interior of the container to the suction chamber, the supplementary tubes and the main tube comprising terminal portions having a cross-section of smaller diameter which are connected to the central part of the tube by portions of variable cross-section.

BRIEF DESCRIPTION OF THE DRAWING

Further advantages and characteristics will be more apparent from the description of a preferred embodiment of the invention and from the accompanying FIGURE which represents a view of the motor-compressor unit showing the arrangement and structure of the suction conduits which form the subject matter of the present invention.

DESCRIPTION OF THE PREFERRED EMBODIMENT

Figure 1:
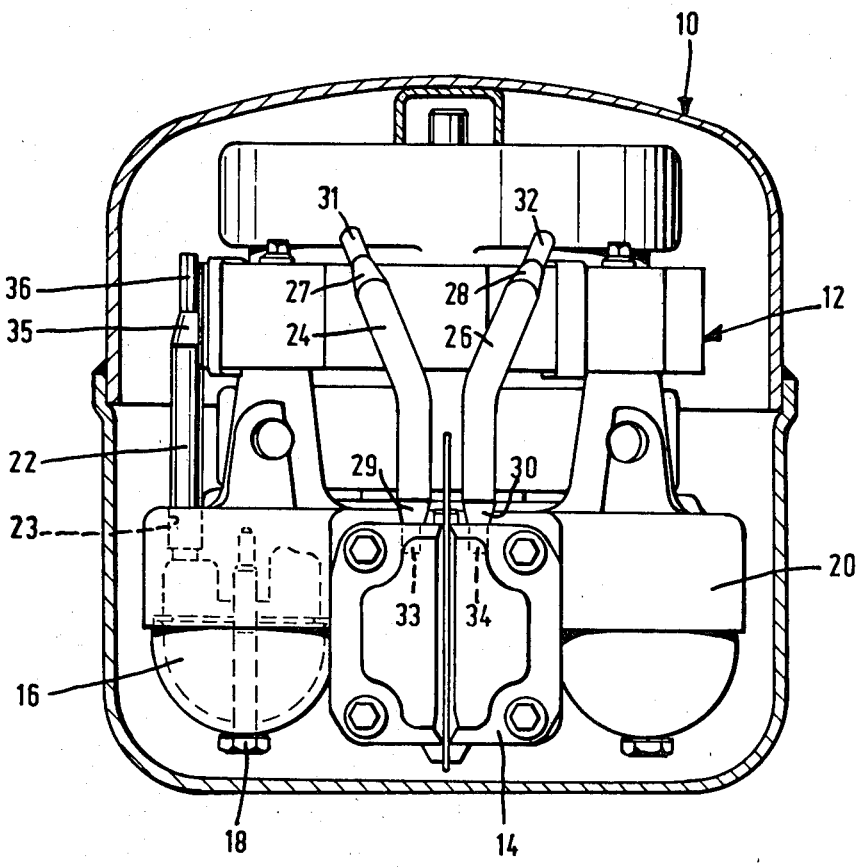

In the FIGURE, the reference numeral 10 indicates the hermetically sealed container in which the motor-compressor unit 12 of piston type is disposed. In order to simplify the description, those parts of the compressor which do not relate in the subject matter of the invention are not illustrated, these being entirely the same as those used in commercially available motor-compressor units of the type considered.

The cylinder head 14 in which the suction and delivery chambers (not shown on the drawing) are provided is located in the lower part of the motor-compressor unit 13. A silencer 16, fixed by the bolt 18 to the compressor body 20 communicates with the suction chamber of the cylinder head 14 by means of a suitable duct provided in the body 20 in known manner. A suction tube 22 is inserted into an aperture 23 provided in the body 20, and connects the silencer 16 to the interior of the container 10. The terminal parts of two supplementary tubes 24 and 26 are inserted into two suitable bores in the top of the cylinder head 14, and directly connect the interior of the container 10 to the suction chamber provided in the cylinder head 14. At their two ends, the two supplementary tubes comprise tapered portion 27, 28 and 29, 30 and cylindrical terminal portions 31, 32 and 33, 34 of a smaller diameter than the central portion.

The upper free portion of the main tube 22 is of like configuration, provided by the tapered portion 35 and the cylindrical portion 36 of smaller diameter.

The central portion of the supplementary tubes 24 and 26 is divided into two parts substantially of equal length, their axes being inclined to each other by a suitable angle as shown in the FIGURE. The angle formed by the axes of the two portions can be considered to be about 155°. Because of the configuration and arrangement of the suction conduits as represented in the FIGURE, an optimum solution is obtained in terms of the quantity of gas drawn in and the noise reduction. The pressure drops in the pulsating flow of the gas due to the special arrangements used for the feed tubes, namely the changes in cross-section and direction for the purpose of obtaining low noise, have been compensated by the use of supplementary suction tubes of suitable configuration to give a correct compromise between noise reduction and induced gas throughput.

What is claimed is:

1. In a motor-compressor unit for refrigerators housed in a hermetically sealed container, comprising a cylinder head in which the suction and delivery chambers are provided, and means for feeding the refrigerant gas enclosed in said container to said suction chamber constituted by a main tube in communication at one end with said container and at the other with a silencer which is itself connected to said suction chamber, the improvement comprising supplementary tubes which directly connect said container to said suction chamber, said supplementary tubes and said main tube comprising terminal portions having a cross-section of smaller diameter which are connected to the central part of the tube by portions of variable cross-section.

2. The motor-compressor unit for refrigerators as claimed in claim 1, wherein said supplementary tubes have their central portion divided into two parts, the axes of which form a contained angle substantially equal to 155°.

* * * * *